United States Patent [19]

Evrard

[11] Patent Number: 4,484,930

[45] Date of Patent: Nov. 27, 1984

[54] GAS PRODUCER

[76] Inventor: Willy I. A. J. Evrard, Place des Tilleuls 19, B5220, Andenne, Belgium

[21] Appl. No.: 410,075

[22] Filed: Aug. 20, 1982

[30] Foreign Application Priority Data

Aug. 25, 1981 [BE] Belgium ..... 890080

[51] Int. Cl.[3] ..... C10J 3/20; C10J 3/84

[52] U.S. Cl. ..... 48/76; 48/87; 48/128

[58] Field of Search ..... 48/87, 128, 76, 111, 48/56; 55/244, 246, 260

[56] References Cited

U.S. PATENT DOCUMENTS

| | | | |
|---|---|---|---|
| Re. 23,048 | 11/1948 | Tweit | 48/87 |
| 184,049 | 11/1876 | Ofeldt | 48/87 |
| 316,520 | 4/1885 | Bowes | 48/87 |
| 764,922 | 7/1904 | Davis | 48/128 |
| 925,415 | 6/1909 | Akerlund | 48/87 |
| 1,013,368 | 1/1912 | Blomfeldt | 55/244 |
| 1,497,098 | 6/1924 | Haug | 48/87 |
| 3,239,999 | 3/1966 | Price | 55/244 |

FOREIGN PATENT DOCUMENTS

| | | | |
|---|---|---|---|
| 891845 | 12/1943 | France | 48/111 |
| 307707 | 1/1930 | United Kingdom | 55/244 |
| 364926 | 1/1932 | United Kingdom | 55/244 |

*Primary Examiner*—S. Leon Bashore
*Assistant Examiner*—Michael K. Boyer
*Attorney, Agent, or Firm*—Holman & Stern

[57] ABSTRACT

In order to ensure a comparatively high purification of gas, a gas producer is provided with a gas treatment stage consisting of a water tank having a gas inlet pipe terminating in a vertical section opening upwards under a bell housing floating on the water by means of a floating system provided with annular ribs. The flotation system further includes a projecting flange just above the water surface. Once the gas has passed from beneath the bell housing to an upper part of the tank it is drawn off by a blower and discharged, e.g. to a gas engine. A valve controlled recirculation line is provided between the blower and the upper part of the tank.

3 Claims, 4 Drawing Figures

GAS PRODUCER

BACKGROUND OF THE INVENTION

The present invention relates to improvements in the apparatus producing a combustible gas and more particularly in apparatus called gazogenes or gas producers and especially those producing so-called poor gas. The poor gas produced can be used for different applications. One very interesting application is for fueling engines used not only for static but also for mobile applications, e.g. on vehicles.

The utilisation of these gas producers to fuel engines has been known for a long time. The basic fuels used are various: for example charcoal, peat, lignite, coal (for example anthracite), coke and even wood and agricultural wastes.

The obtained gas is normally produced by an incomplete combustion of the carbon in an air draught passing through a substantial thickness of combustible.

This gas, commonly called "gas by air", principally contains nitrogen, carbon monoxide and, incidentally, carbon dioxide, hydrogen, methane, and possibly a very small quantity of ethane.

The classic gas producers are fundamentally constituted by a chamber for the combustible material, of which chamber the lower part is constituted by a frustum of a cone closed at its lower part by a grill, an induction system for combustion air to the gas producer possibly by suction and an arrangement for treatment of the obtained gas. For fueling the engines, a gas of the highest quality has to be obtained; for this reason this has to be purified as much as possible.

Developments have been concerned with mechanical improvement of the apparatus to increase the reliability and the flexibility of the production and with improvements of the treatment of the produced gas. For the production of the poor gas used for fueling engines the gas producer needs to be followed by different accessories such as a cooler, a mechanical cleaner, a scrubber and so forth.

SUMMARY OF THE INVENTION

The present invention relates to improvements in apparatus producing gas and the main object of the invention is a system for producing gas which has been freed of its impurities at the time of combustion and the treatment of the gas produced. This improved system ensures the production of gas intended to supply the engine in very economical conditions without causing the furnace or the filtering elements to becc me blocked.

The improved gas producer, according to the present invention, comprises in series a fuel storage hopper, a furnace supplied with air, means for treating the gas produced and means for supplying a gas engine, in which a gas production system comprises, between the hopper and the furnace, a zone of decreasing section, the walls of which are heated by the furnace, and in which the gas treatment system comprises in series at least one lamellar filtration apparatus, a washing apparatus and a centrifuging apparatus.

According to one embodiment of the invention the lower end of the zone located between the fuel store and the furnace, which is called the intermediate zone, has the same shape but a smaller section than the upper end of the zone forming the furnace, and openings are arranged in the space separating the walls of the two zones in order to allow the transmission of the heat issuing from the furnace.

The intermediate zone at a high temperature presents ideal conditions for dry pyrolysis of certain constituents of the fuel before they arrive at the furnace; in addition, the hot walls on which certain residues of pyrolysis are deposited destroy these residues and in particular tarry residues. During their later passage into the furnace undesirable elements are thus converted into $CO_2$, $CH_4$, $H_2$ . . . and their subsequent contact with incandescent products located downstream again converts these gases into useful products, for example into CO.

The first aspect of the apparatus of the invention entails an interesting improvement in the production of clean gas while removing residues which are always in the way when they stagnate in the apparatus and in particular at the bottom of the hopper and along the walls of the furnace.

In a particularly advantageous variation the gas treatment means comprises a watertight vessel partially filled with water, a pipe for introducing gas into the said vessel, the section of the pipe near the exit of the gas being substantially cylindrical and in a substantially vertical position, the exit being upwardly directed, a bell housing having its longitudinal axis substantially vertical being disposed above the top opening of the said pipe, the internal cross section of the said bell housing being larger than the external cross-section of the said pipe the said bell housing being provided around its base with means for floating of the bell on the surface of the water contained in the said vessel, the said vessel being in addition provided with means for the introduction and discharge of water, and at the top with means for drawing off the gas.

According to a preferred embodiment of the invention, the system for treating the gas comprises a device for maintaining the water at a constant level in the vessel; this device may be for example constituted by a pipe having one exit situated inside the vessel, at the height of the desired water level and having the second exit outside the vessel, at a level lower than the desired water level.

According to another embodiment of the invention the bottom surface of the floating means of the bell, which comes into contact with the water contained in the vessel is flat; nevertheless it is within the scope of the invention that this contact surface is provided with protuberances for example annular ribs of a diameter greater than the diameter of the feeding gas pipe.

According to another embodiment of the invention, the bell is provided at the part of its base which is the furthest from the longitudinal axis, with means for holding the water, for example a flat ring situated on the bell just near and above the water surface level.

In a particular realisation of this last embodiment, the means for holding the water are situated at a sufficient distance from the surface of the water to ensure a contact between the water flow held by the said means and falling down into the vessel, and the gas going up. The means for treating the gas may comprise at the exit of the vessel, means for mechanical purification of the gas, for example by centrifuging, by abrupt deviation of the gas flow, and so forth.

The gas treatment means can be provided with means to send back the unused gas to the vessel. Following an advantageous form of this invention, the means for recirculating the gas includes a valve system in which the opening and closing positions are regulated by the pressure variations in the top part of the exterior water tank.

The apparatus is preferably provided with guide means for the bell housing which is entered by the gas inlet pipe.

The water tank may comprise two coaxial enclosures namely an interior enclosure, having a circular horizontal section, containing the gas inlet pipe and the floating bell housing, and an exterior water tank, in which the precleaned gas is thrown down at a low speed into the water contained in the tank and so treated mechanically before being sent to the engine. The two enclosures may be connected in the inferior part of the tank. Under these conditions, the fan establishes a depression in the interior enclosure and a pressure in the exterior enclosure.

The improved gas treatment system which is the first object of this invention, combines the lamellar filtration of the gas (when the gas, coming from inlet gas pipe is constrained by the bell housing, to take a downward direction following the preferably ribbed surface of the bell housing), the washing of the gas (by the through passage of the water retaining device situated on external side of the bell housing) and a centrifuging system (for instance, by passage through a cyclone situated on the outside of the water tank). This system thus enables production of clean gas.

It must be noted that this system is free from blocking or obturation because the principal zone of treatment is formed by mobile surfaces namely the water surface and the floating bell housing surface). The treating water is simply regenerated, when charged by dust and other elements taken out of the gas, by emptying and refilling. This system is self regulating due to the fact that the bell housing, when the water level is too low, closes the gas inlet pipe. If the water flow is excessive so that the self-levelling device cannot maintain the water level, then the bell housing eventually sinks relative to the water and effectively increases the resistance to gas flow, so cutting off the gas supply to the engine, which eventually stops.

Finally, the system enable such control of feed to the engine due to the fact that the regulation of the gas flow is possible and the flexibility of running is completed.

The present invention also comprises improvements in the feeding of the gas generator itself.

According to this aspect of the invention, a first improvement consists in giving the combustible material chamber a transverse interior section which is square or rectangular in which the corners are formed by interiorly recess corners having vertical axes.

BRIEF DESCRIPTION OF THE DRAWINGS

The attached figures of drawing which are not to scale, illustrate by way of a non-limiting example, the improved apparatus for producing gas which is the object of the invention. In the drawings.

DETAILED DESCRIPTION OF THE INVENTION

Figure 1:
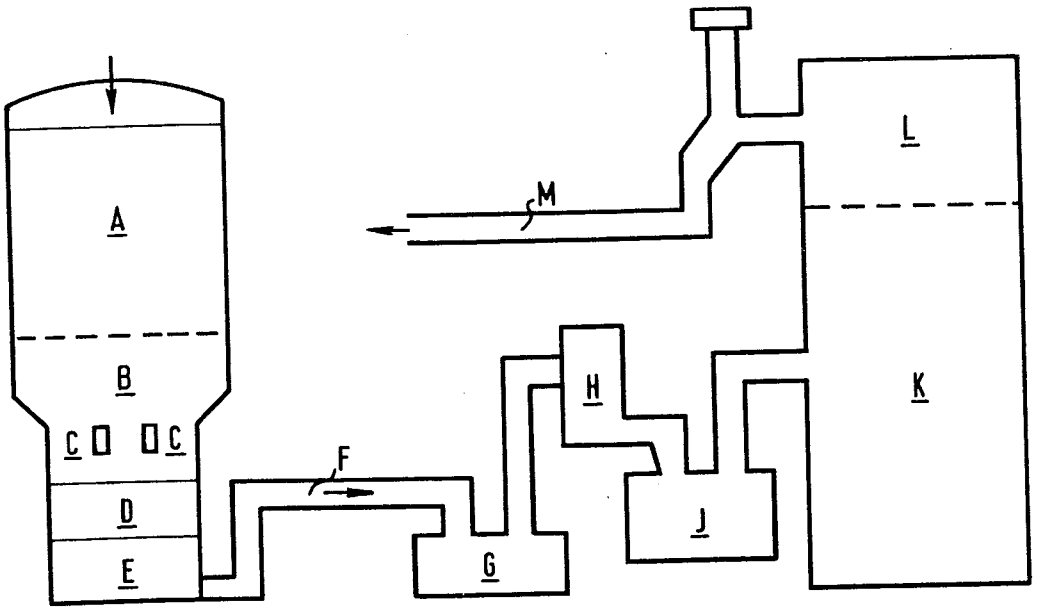
FIG. 1 is a diagrammatic representation of the different parts forming the gas producer.

In FIG. 1 the different elements forming the gas producer can be seen and are enumerated hereinafter according to the passage of the materials; the store hopper (A) comprises at its base a zone (B) having the tuyere-carriers (C) where the fuel is ignited; below the furnace (D) an ash discharge hole (E) is arranged, at the base of which the gases produced are extracted; a pipe (F) conveys these gases from the production apparatus to the treatment apparatus comprising in the case of FIG. 1 a cyclone (G), a pre-cooling system (H), a water trap (J) and finally an improved apparatus for filtration and washing (K), surmounted by a suction section (L); the purified gases are sent by a pipe (M) to the engine to be supplied.

Figure 2:
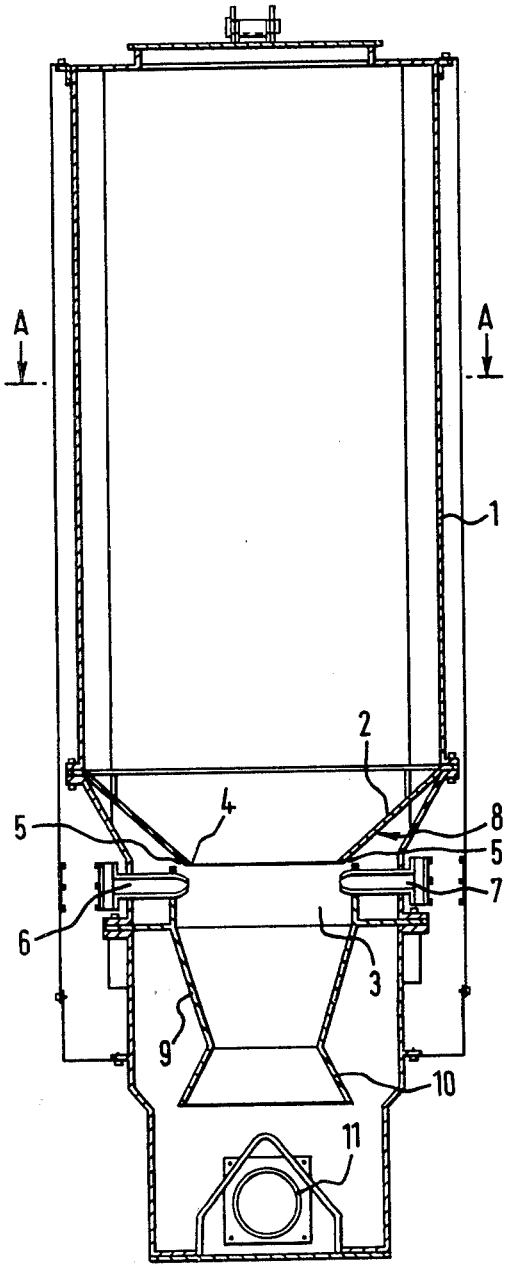
FIG. 2 shows in vertical section a plan view of the gas production system.

FIG. 2 shows in greater detail the "gas production" part; it shows (1) the supply store hopper and at its base zone (2) with a decreasing section, called the intermediate zone, which is located above the furnace zone (3); the lower opening (4) of the intermediate zone (2) having the same shape but a smaller perimeter than the upper opening of the furnace zone such that there is a space (5) between the two sections. The furnace zone (3) is provided with air injectors (6) and (7) or tuyeres which ensure combustion at this point.

It is understood that a part of the heat rising from the furnace is transmitted through the space (5) and brings the walls (8) of the zone called the intermediate zone (2) to a high temperature.

Below the furnace zone (3) the gas production system also comprises a lower zone with a section which at first decreases (9) and is then hollowed (10) by which the gases are extracted in order to be sent to the purification system via a pipe (11).

Figure 3:
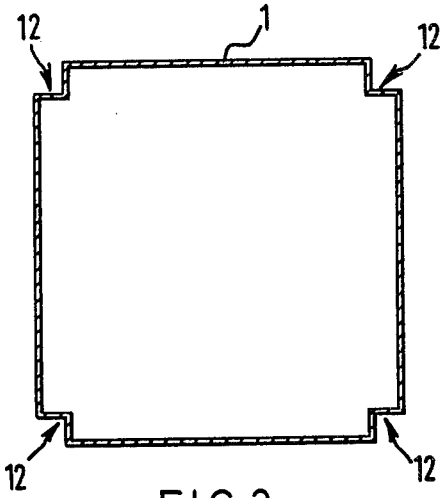
FIG. 3 shows in horizontal section a section of the supply store hopper.

FIG. 3 represents a cross section of the store hopper (1) showing the corners (12) which are reinforced internally in order to reduce the risks of clogging the store.

Figure 4:
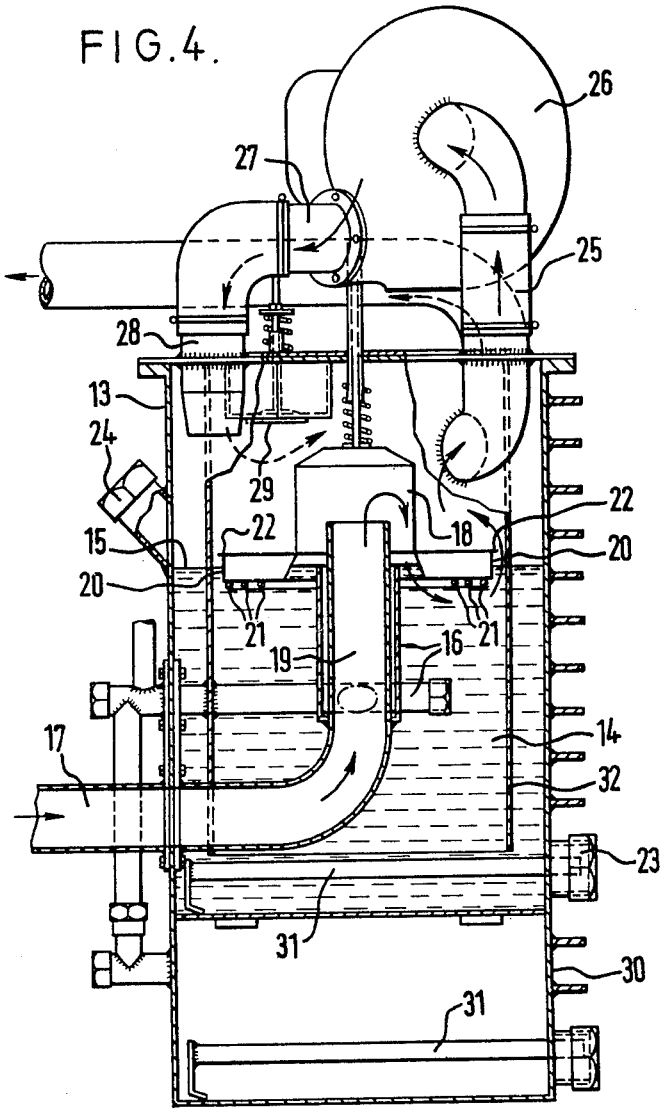
FIG. 4 shows in vertical section the system for treating the gas produced.

FIG. 4 shows an impermeable water tank 13 partly filled with water 14 up to the level 15 constantly maintained by a maximum level and surplus water evacuation device 16. A gas inlet pipe 17 introduces the gas above the water level 15 and, above the gas exit orifice of pipe 17, there is situated a bell housing 18 having a longitudinal axis parallel with the longitudinal axis of the upper part of the inlet pipe 17. The base of the bell housing 18 is provided with a annular floating system 20 of which the interior surface in contact with the water is equipped with annular ribs 21, the combination constituting a lamellar filtration apparatus. A flat annular flange 22 is situated around the bell housing floating system just above the water level 15. The water tank 13 is also equipped with an exit pipe 25 for the exit of the gas. The pipe 25 is connected with a fan or blower 26 which is followed by a pipe 27 sending the gas to the engine, the combination constituting a centrifuging apparatus.

This pipe 25 is equipped with a diversion system 28 permitting the recirculation of the gas to the water tank 13, the access to this deviation system being controlled by a valve 29 whose opening is regulated by the fueling needs of the engine or by the depression in the water tank.

The arrows on the drawing illustrate the paths of the gas in the gas treatment system. The arrows drawn in dotted lines show the path of the gas recirculated to the water tank 13.

In the bottom part of the water tank 13, there is an enclosure 30 collecting the water coming from the overflow 16. Means 32 are placed to collect the wastes which come from the water tank and from the enclosure 30.

In the version shown in the drawing, the water tank is constituted by two coaxial enclosures. These two enclosures are connected by their lower parts.

I claim:

1. Apparatus for producing gas, comprising in series a fuel store hopper, a furnace supplied with air, means for treating the gas produced comprising in series at least one lamellar filtration apparatus, a washing apparatus and a centrifuging apparatus, and means for supplying a gas engine, wherein the store hopper is located above the furnace and a lower portion of the hopper, proximal of the furnace has a cross-section which tapers towards the furnace, said lower portion adjacent the furnace having the same shape as an upper end of the furnace, but having lateral dimensions less than the laterial dimensions of the upper end of the furnace, means defining an opening are arranged in the space separating the lower portion of the hopper and the upper end of the furnace to allow the transmission of heat from the furnace to the walls of the lower portion to heat said walls; said gas treatment means comprises a watertight vessel partially filled with water, a pipe for introducing gas into said vessel, the section of the pipe near the exit of the gas being of substantially cylindrical section and in a substantially vertical position and opening upwards, a bell housing having a longitudinal axis substantially vertical being disposed above the top opening of said pipe and the internal cross-section of said bell housing being larger than the external cross-section of said pipe, said bell housing being provided around its base with means for floating the bell on the surface of the water contained in said vessel, said vessel being further provided with means for the introduction and draining of water, a device for maintaining the water at a constant level in the vessel, and, at the top, with means for drawing off the gas.

2. The apparatus of claim 1 wherein the lamellar filtration apparatus comprises protruding rings provided on the water contacting surface of the floating means, said rings having a diameter greater than the diameter of the inlet gas pipe, the bell housing is provided at the part of its base at the furthest distance from the longitudinal axis with a flat ring projecting from the bell housing and situated just near and above the floating surface, the means for drawing off the gas is in the form of a blower or fan and in which the gas treatment means includes means for recirculating to the vessel, gas coming from the vessel and which is not passed on to the engine.

3. The apparatus of claim 2 wherein the recirculating means for the gas in the vessel comprises a valve of which the opening and closing positions are regulated by the pressure variations in the top part of the tank exterior of the water, guide means are provided to ensure permanent location of the bell housing above and around the top of the inlet gas pipe, and in which the water tank comprises two coaxial enclosures, the inner enclosure enclosing the gas inlet pipe and the bell housing, and the two enclosures being connected by their lower parts which are filled with water.

* * * * *